US007631375B2

(12) United States Patent
Quintile

(10) Patent No.: US 7,631,375 B2
(45) Date of Patent: Dec. 15, 2009

(54) BED BASE

(75) Inventor: Mark J. Quintile, Brunswick, OH (US)

(73) Assignee: Mantua Manufacturing Co., Walton Hills, OH (US)

( * ) Notice: Subject to any disclaimer, the term of this patent is extended or adjusted under 35 U.S.C. 154(b) by 28 days.

(21) Appl. No.: 11/947,892

(22) Filed: Nov. 30, 2007

(65) Prior Publication Data

US 2009/0139027 A1 Jun. 4, 2009

(51) Int. Cl.
*A47C 19/02* (2006.01)

(52) U.S. Cl. ..... 5/200.1; 5/400; 5/207; 5/286

(58) Field of Classification Search ..... 5/200.1, 5/201, 203, 207, 208, 285, 286
See application file for complete search history.

(56) References Cited

U.S. PATENT DOCUMENTS

| | | | | |
|---|---|---|---|---|
| 3,877,091 | A | 4/1975 | Jureit et al. | |
| 4,019,211 | A | 4/1977 | Spitz | |
| 4,027,343 | A | 6/1977 | Hooker | |
| 4,074,372 | A | 2/1978 | Schulz, Jr. | |
| 4,276,665 | A | 7/1981 | Mis | |
| 4,295,234 | A | 10/1981 | Whitehead | |
| RE31,384 | E | 9/1983 | Mis | |
| 4,428,086 | A | 1/1984 | Harris | |
| 5,012,538 | A * | 5/1991 | Timm | 5/200.1 |
| 5,095,565 | A | 3/1992 | Brown | |
| 5,920,930 | A * | 7/1999 | Harrow | 5/201 |
| 5,996,145 | A | 12/1999 | Taylor | |
| 6,125,484 | A | 10/2000 | Thomson | |
| 6,449,786 | B1 | 9/2002 | Voit | |
| 6,560,796 | B1 | 5/2003 | Diforio | |
| 6,588,035 | B2 | 7/2003 | Le Duc et al. | |
| 6,711,765 | B1 | 3/2004 | Mitchell, III et al. | |
| 6,851,140 | B2 | 2/2005 | Polevoy et al. | |
| 6,865,758 | B2 * | 3/2005 | Harrow | 5/288 |
| 6,925,666 | B2 * | 8/2005 | Harrow | 5/201 |
| 6,941,594 | B1 | 9/2005 | Mosley | |
| 6,941,596 | B2 | 9/2005 | Schuman et al. | |
| 6,948,199 | B2 | 9/2005 | Hooper, Jr. | |
| 7,134,154 | B2 | 11/2006 | Cloer et al. | |
| 7,219,378 | B2 | 5/2007 | Polevoy et al. | |
| 2004/0093670 | A1 | 5/2004 | Polevoy et al. | |
| 2004/0187208 | A1 | 9/2004 | Harrow | |
| 2006/0195982 | A1 | 9/2006 | Cloer et al. | |
| 2007/0039099 | A1 | 2/2007 | Kozlowski et al. | |
| 2007/0157381 | A1 | 7/2007 | Polevoy et al. | |
| 2007/0226902 | A1 | 10/2007 | Lin | |

* cited by examiner

*Primary Examiner*—Michael Trettel
(74) *Attorney, Agent, or Firm*—Roetzel & Andress

(57) ABSTRACT

A bed base for supporting a mattress, a mattress foundation or combination thereof or any other support structure has intersecting and interlocking side walls. Each side wall has an upper and lower web with configurations which engage and lock with the upper and lower webs of intersecting side walls at corners of the bed base. Cross braces are disclosed which extend transversely across the side walls, and which extend into the upper webs of parallel side walls. Legs on the cross braces may be co-located with the side walls and extend through the upper webs and down to the lower webs. The corners of the bed base may be reinforced with a corner piece which fits over the upper webs of the intersecting side walls, and covered by a corner guard which extends over portions of the side walls at the corners.

25 Claims, 6 Drawing Sheets

BED BASE

RELATED APPLICATIONS

There are no applications which are related to this application.

FIELD OF THE DISCLOSURE AND INVENTION

The present disclosure and invention is in the general field of bases and structures for supporting other structures or devices.

BACKGROUND OF THE DISCLOSURE AND INVENTION

Frames and support structures for mattresses and mattress/foundation sleep sets are designed to provide an elevated support to position the sleep surface of the mattress at conventional heights. The frames and support structures have traditionally been constructed of wood or steel, and consist of perimeter members which define a boundary about the perimeter of the foundation, cross members which extend transversely or longitudinally between opposite sides of the perimeter, and vertical legs which elevate and support the perimeter and cross members. The assembly of these components and members requires brackets, braces, fasteners and related hardware for strong interconnection. Due to size, bed frames are shipped in an un-assembled state and assembled on site. The assembly requires handling and arrangement of the frame members and interconnection by installation of each of the fasteners. For many frame designs this is a very complicated and time consuming process. Also, the greater number of brackets and fasteners increases the risk of the loss of one which would prevent assembly. Frames which rely upon fasteners such as bolts and nuts to hold the frame in a rigid assembled state may become loosened over time, and are susceptible to relative movement between the frame members which can also cause squeaking.

SUMMARY OF THE DISCLOSURE AND INVENTION

The present disclosure and related inventions provide a novel bed base for supporting a mattress, foundation, or mattress/foundation combination or sleep set or any other type of support platform. The bed base of the disclosure provides a strong structural support and elevation which is easy to assemble, and which does not rely upon individual mechanical fasteners for assembly, alignment and securement in the assembled state. In a preferred embodiment of the disclosure, each of the structural components of the bed base are engaged and locked with mating components without requiring any separate fasteners or devices at the interface of mating components.

In one embodiment of the disclosure, there is provided a generally rectangular bed base which includes four intersecting perimeter walls which joined together at respective intersecting ends of the walls to form a rectangular frame which also has a vertical dimension. The corners of the rectangular frame are reinforced by one or more overfit components which maintain a right angle intersection of the walls of the frame at each corner. Cross brace members are arranged generally transverse to a length of the rectangular frame and are engaged and locked with longitudinal perimeter walls of the frame. Each of the cross brace members has one or more vertical legs which support the cross brace at a common elevation with a top of the perimeter walls.

Further in accordance with the disclosure, a bed base for supporting a mattress or mattress foundation has four intersecting side walls, each side wall having a length dimension extending between ends where the side walls intersect, and a height dimension (also sometimes alternatively referred to as "width") extending between upper and lower edges, an upper web formed along the upper edges, a lower web formed along the lower edges, an upper tab formed in the upper web at ends of two of the side walls, and a lower slot formed in the lower web at the ends of the same two side walls, an upper slot formed in the upper web at ends of the remaining two side walls, and a lower tab formed in the lower web at ends of the remaining two side walls; the upper tabs of two of the side walls engaged with the corresponding upper slots of the remaining two side walls, and the lower tabs of the remaining two side walls engaged with the lower slots of the two side walls.

These and other aspects of the disclosure are herein described in further detail with reference to the accompanying Figures which depict exemplary and representative executions and embodiments of the principles and concepts of the invention.

DETAILED DESCRIPTION OF PREFERRED AND ALTERNATE EMBODIMENTS

Figure 1:
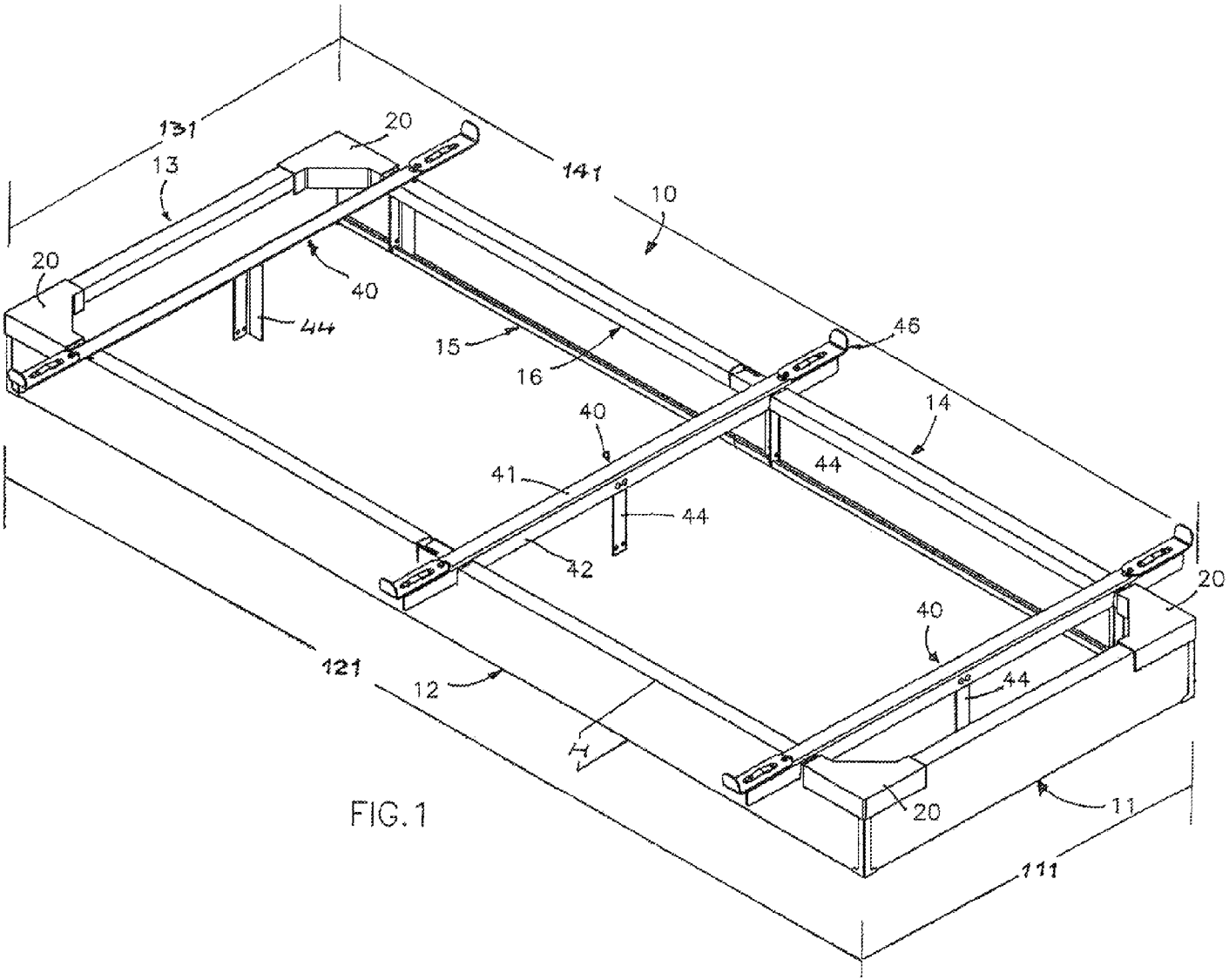
FIG. 1 is a perspective view of a bed base of the disclosure.

As shown in FIG. 1, the disclosure includes a bed base, indicated generally at 10, which in this particular form is generally rectangular and configured to receive and support a platform or support surface or mattress or mattress foundation, or a mattress/foundation combination, also sometimes referred to as a "sleep set", wherein the foundation (sometimes referred to as a "box spring") is relatively rigid support structure with a height dimension, and width and length dimensions comparable to a mattress which is positioned on top of the foundation. The bed base 10 includes four side walls including transverse side walls 11 and 13, and longitudinal walls 12 and 14, collectively and interchangeably referred to herein as "side walls". Each side wall has a planar expanse or plane (i.e. the primary wall area which is generally vertically oriented in the erected bed base), a length dimension measured longitudinally, and a height dimension measured from a lower edge to an upper edge, and oriented with the longitudinal dimension horizontal and the height dimension vertical. The four side walls are interconnected at respective ends to form a generally rectangular frame. Each side wall has a respective length 111, 121, 131, 141 and a common height dimension H. As shown in FIGS. 2-5A, each side wall has formed at a lower edge thereof a lower web or flange 15 formed along a bottom edge, and at an upper edge thereof an upper web or flange 16 formed along a top edge. The lower web 15 preferably has a width dimension which extends inward toward the interior of the frame formed by the side walls. The lower web 15 includes a horizontal segment 151 which is generally perpendicular to the vertically oriented face of the side wall, and a vertical segment 152 which spaced from and parallel with the vertically oriented face of the side wall, and may further have a second horizontal segment 153 which is spaced from and parallel with horizontal segment 151. Similarly, the upper web 16 has a horizontal segment 161 which is generally perpendicular to the vertically oriented face of the side wall, and a vertical segment 162 which spaced from and parallel with the vertically oriented face of the side wall, and may further have a second horizontal segment 163 which is spaced from and parallel with horizontal segment 161. The disclosure is not limited to any particular size or width of any of the segments of the lower or upper webs. In representative embodiments, the lower and upper webs may have similar or dissimilar dimensions, such as for example the size of the segments 161, 162 and 163 of the upper web 16 being at least slightly larger than segments 151, 152 and 153 of the lower web 15 for strength or other design considerations. By these representative constructions alone, formed for example in any suitable gauge of sheet steel, for example and without limitation in the approximate range of 22-17 gauge, and by the vertical orientation and interlocked intersection of the side walls in the assembled state, the side walls provide a frame of sufficient strength, rigidity and alignment form a strong foundational base for a mattress or sleep set. It is within the disclosure that the relative arrangement of the described tabs and slots may be varied between the intersecting side walls, such that the location a cooperating tab and slot may be reversed or exchanged between intersecting side walls.

Figure 2:
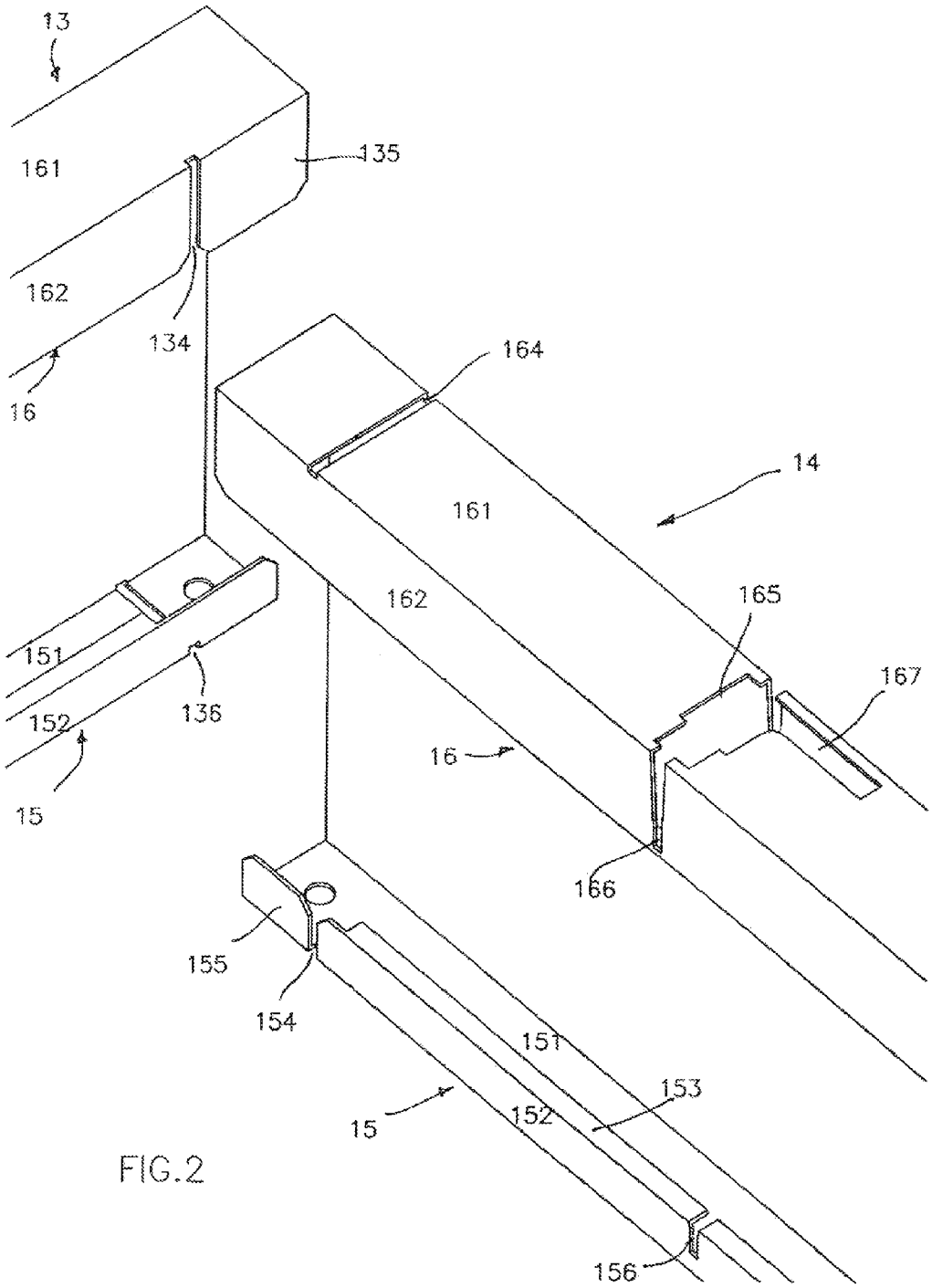
FIG. 2 is an assembly view of intersecting and interlocking ends of side walls of a bed base of the disclosure.

FIG. 2 illustrates a further structural and design detail of intersecting and interlocking ends of side walls of the bed base, such as transverse side wall 13 and longitudinal side wall 14. In the upper web 16 of transverse side wall 13 a slit 134 is formed to create an upper tab 135 from the upper vertical segment 162. Similarly, in the lower web 15 of longitudinal side wall 14 a slit 154 is formed to create a lower tab 155 from the lower vertical segment 152. A tab-receiving slot 164 (referred to herein as the "upper slot") is formed in the segment 161 of the upper web 16 of the longitudinal side wall to receive tab 135 of the transverse side wall 13. A tab-receiving slot 136 (referred to herein as the "lower slot") is formed in the horizontal segment 151 of the lower web 15 of the transverse side wall 13 to receive tab 155 of the longitudinal side wall 14. Because the extent of the vertical segment 162 of the upper web 16 from segment 161 of both side wall 13 and side wall 14 is greater than that of segment 152 from segment 151 in the lower web 15 of both side wall 13 and side wall 14, the tab 135 can be inserted within tab-receiving slot 164 before a distal end of tab 155 reaches insertion into the tab-receiving slot 136. This dimensional design greatly facilitates ease of assembly of the intersecting side walls of the bed base.

As shown in FIGS. 1, 3 and 5A and 5B, once each corner of the frame is assembled by the described interlocking connection of the respective ends of the intersecting side walls, a corner piece 20, also referred to herein as an "overfit component", is installed over the top webs 16 of the side walls, such as intersecting side walls 13 and 14. The corner piece 20 has perpendicular first and second channels 201, which are orthogonal and each with an internal width dimension which corresponds to the external width of segments 161 of the upper webs 16, to fit closely over the webs 16. A back wall 202 of the corner piece 20 forms a right angle structure which fits closely against the exterior of the intersecting side walls. A front wall 203 of the corner piece extends between the intersecting channels 201. A top surface 204 of the corner piece 20 extends from the back wall 202 to the front wall 203 and over the channels 201. The corner piece thus rigidly holds the intersecting side walls in the orthogonal relationship which forms the corner of the frame of the bed base. The rigidity of the corner piece, when formed for example of molded plastic with sufficient thickness and reinforcement as known in the plastic injection molding art, contributes significantly to the strength of the frame and the corner structure of the frame. For example, the corner piece 20 prevents any racking or warping of the side walls individually or with respect to the intersecting side wall, to maintain the side walls in fixed orthogonal alignment.

To cover the exterior of the line of intersection of the side walls, such as side walls 13 and 14 and the terminal edges thereof, there may optionally be provided a cover or guard 30 (also referred to herein as a "corner guard") which has corresponding orthogonal walls or flanges 301 which extends over the exterior of a corner formed by the intersection of a transverse side wall and a longitudinal side wall and over a portion of each respective side wall. Positioning of the guard 30 can be accomplished by a pin 302 which is integrally formed with a base 303 of the guard 30 and which fits in openings in the overlapping segments 151 of the lower webs 15. When assembled in the combination depicted in FIGS. 3 and 5A and 5B, the back wall 202 of the corner piece 20 may extend over the uppermost extent of the walls 301 of the guard 30.

Figure 3:
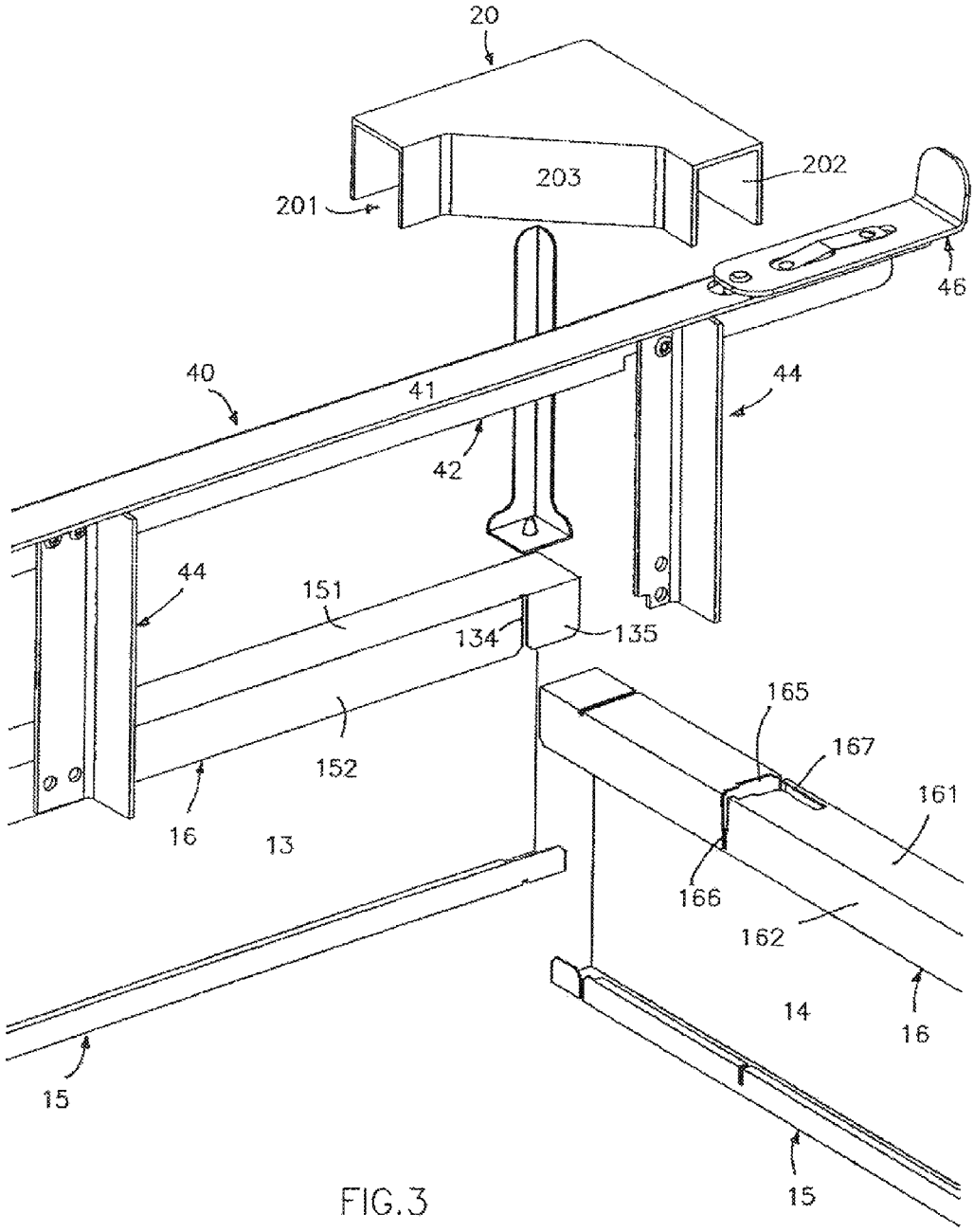
FIG. 3 is an assembly view of a corner region of a bed base of the disclosure.
Figure 4:
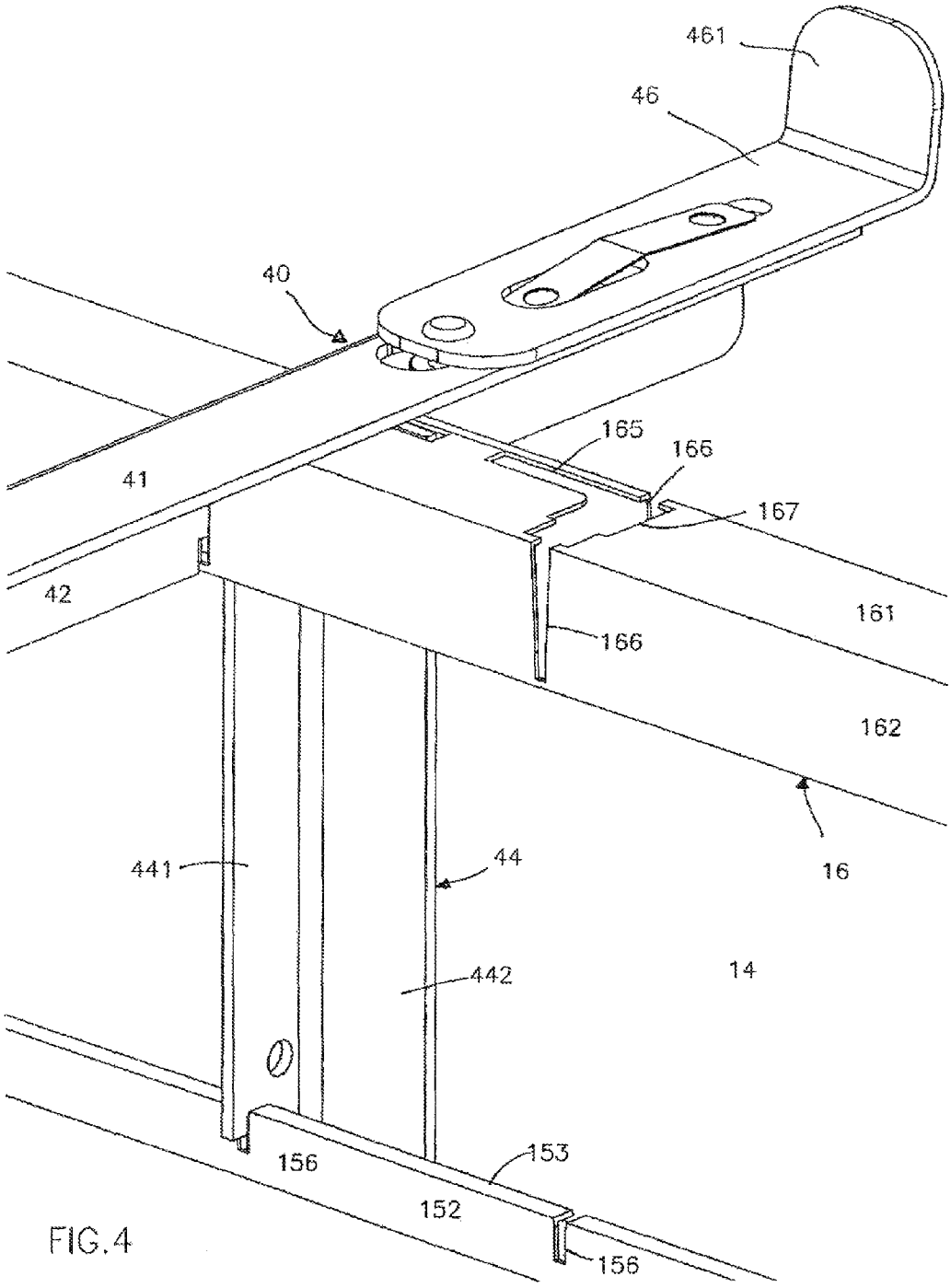
FIG. 4 is a perspective view of a cross brace and wall intersection region of a bed base of the disclosure.
Figure 5A:
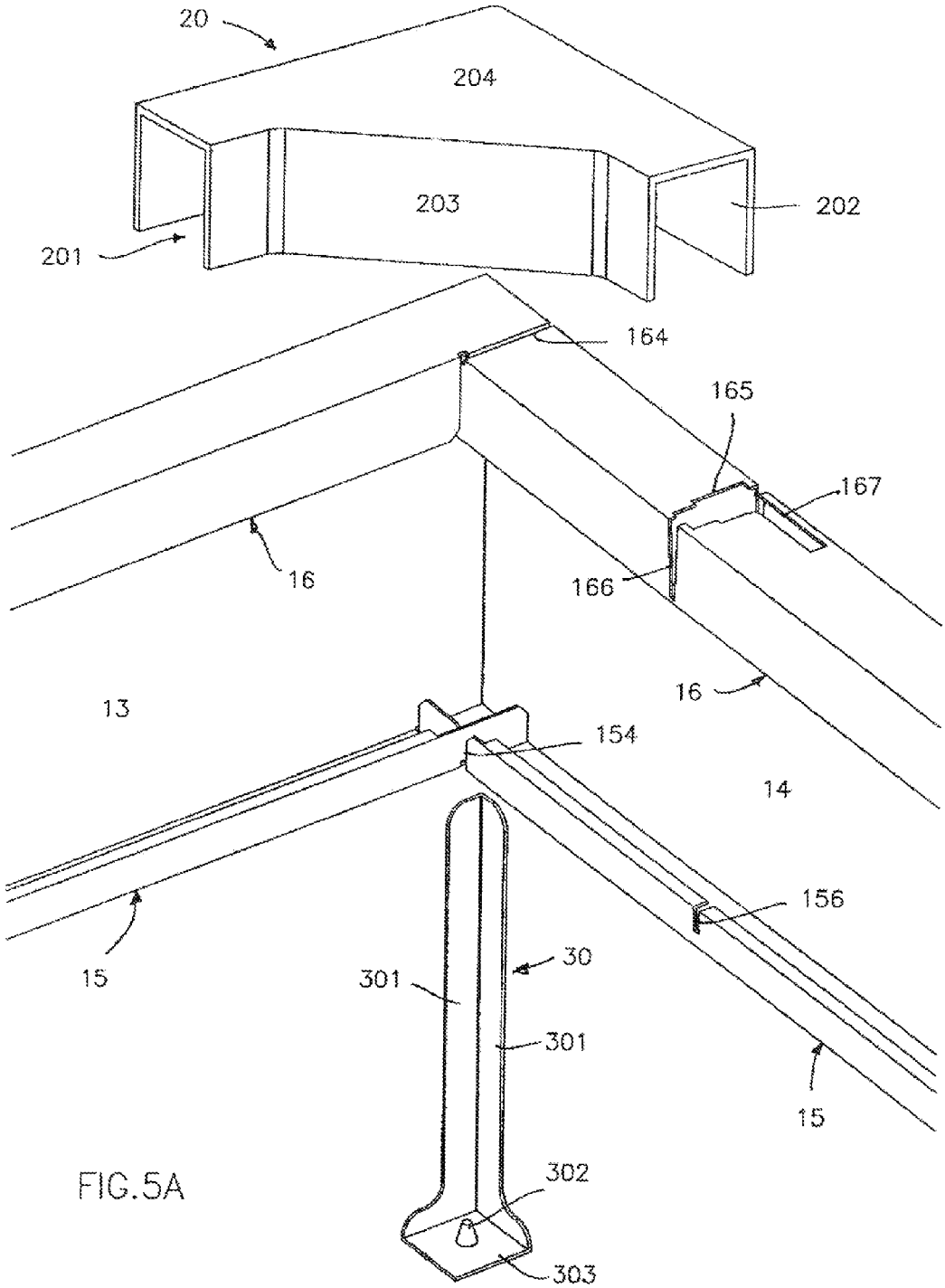
FIGS. 5A and 5B are perspective views of a corner region of intersecting walls and overfit components of a bed base of the disclosure.
Figure 5B:
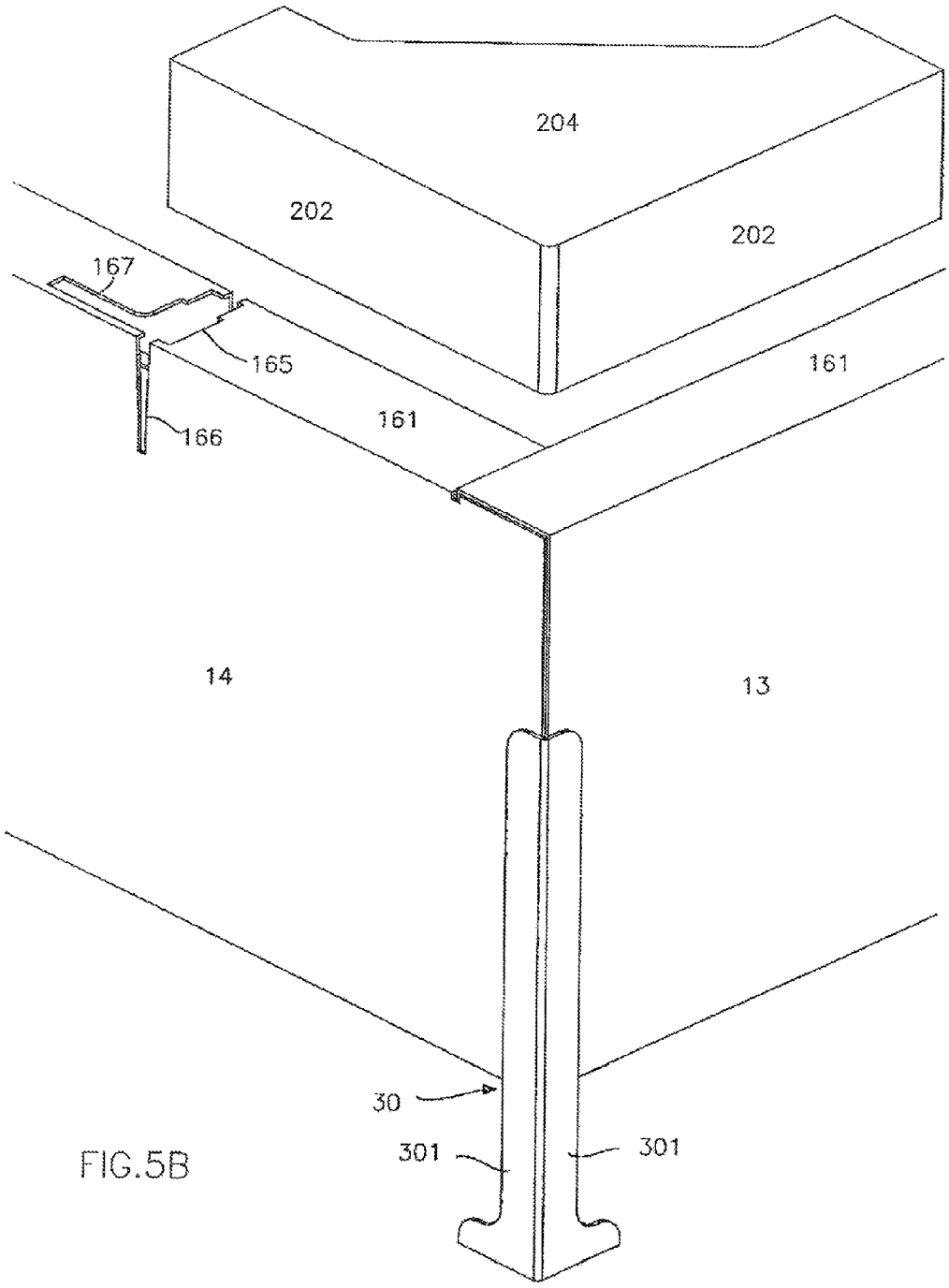

Referring again to FIG. 1, and as further shown in FIGS. 3 and 4, the bed base 10 further includes one or more cross braces, indicated generally at 40 which are arranged transverse to the length of the frame defined by the side walls. Each cross brace 40 preferably has a horizontal segment 41 and a vertical segment 42, which may be generally in the form of a right angle for structural strength and rigidity, and an overall length which is equal to a greater than a width of the frame defined by the side walls, i.e. equal to or greater than a length of the transverse side walls 11 and 13. Formed in the upper webs 16 of the longitudinal side walls 12, 14 are a cross brace receiving opening 165 in horizontal segment 161, and a corresponding and adjoining cross brace receiving slot 166 which extends into vertical segment 162. The opposing edges of the cross brace receiving slot 166 are preferably tapered to provide a friction lock against each side of the vertical segment 42 of the cross brace 40. As shown in FIG. 4, opposing symmetrical openings 165 and slots 166 may be formed at each cross brace location to allow for optional orientation of the horizontal segment 41 of the cross brace 40. Each cross brace 40 may further include one or more cross brace legs 44 which extend perpendicular to the cross brace 40 to the elevation of the lower webs 15 of the side walls. Each cross brace leg 44 may further include first segment 441 and second segment 442, which segments may be perpendicularly or other angular orientation for stiffness and strength. One or more of the cross brace legs 44 may be located at the intersection of the cross brace 40 with a longitudinal side wall 12, 14, and extending through the cross brace receiving opening 165 and a corresponding and contiguous cross brace leg receiving opening 167 which is also formed in the horizontal segment 161 of the upper web 16. A lower distal end 45 of the first segment 441 of the cross brace leg 44 is received within a slot 156 (which may be tapered) formed in the vertical segment 152 of the lower web 15 of the side wall, and may be notched as shown in FIG. 3, and the distal end of the second segment 442 rests upon the horizontal segment 152 of the lower web 15. When tapered, slot 156 functions as a lock for the lower distal end 45 of the first segment 441. By this arrangement the cross brace legs 44 which are located at the intersection of the cross brace 40 with the longitudinal side walls are captured by and located within the longitudinal side walls for structural strength and concealment.

The terminal ends of the cross braces 40 may be further equipped with brackets 46 which are fastened or otherwise secured to preferably the horizontal segment 41 of the cross brace 40 for engagement with or support of a platform or foundation or mattress, and which may further include a vertical segment 461 which extends upward from the horizontal segment 41 to define an overall width of the cross brace end-to-end and brackets 46 and a design support width of the bed base 10.

The invention claimed is:

1. A bed base for supporting a mattress, mattress foundation or both, the bed base comprising:

four interconnected side walls including two transverse side walls and two longitudinal side walls, each side wall having:

a planar expanse and a length dimension between ends and a height dimension between lower and upper edges, a lower web formed at a lower edge and an upper web formed at an upper edge, the lower web having a first segment which extends from the planar expanse and a second segment which extends perpendicularly from the first segment, the upper web having a first segment which extends from the planar expanse and a second segment which extends perpendicularly from the first segment, an upper tab formed in the second segment of the upper web at each end of the transverse side walls, a lower slot formed in the first segment of the lower web proximate to each end of the transverse side walls, a lower tab formed in the second segment of the lower web at each end of the longitudinal side walls, an upper slot formed in the first segment of the upper web proximate to each end of the longitudinal side wall, the upper tabs of the transverse side walls received in the upper slots of the longitudinal side walls, and the lower tabs of the longitudinal side walls received in the lower slots of the transverse side walls.

2. The bed base of claim 1 further comprising at least one cross brace which extends from one longitudinal side wall to another longitudinal side wall.

3. The bed base of claim 2 wherein the at least one cross brace extends over each of the longitudinal side walls.

4. The bed base of claim 2 wherein the at least one cross brace is engaged with an upper web of each of the longitudinal side walls.

5. The bed base of claim 4 wherein the at least one cross brace has a vertical segment and a horizontal segment, and the vertical segment extends into the upper webs of each of the longitudinal side walls through an opening formed in the upper webs of each of the longitudinal side walls.

6. The bed base of claim 2 comprising three cross braces, including an end cross brace located proximate to each end of the longitudinal side walls, and a cross brace located between the end cross braces.

7. The bed base of claim 2 wherein the at least one cross brace further comprises at least one leg which extends from the cross brace to a lower edge of the side walls.

8. The bed base of claim 7 wherein the at least one leg of the at least one cross brace extends through an opening in an upper web of a longitudinal side wall and extends to the lower web of the longitudinal side wall.

9. The bed base of claim 8 wherein a distal end of the at least one leg of the at least one cross brace fits in a slot formed in the lower web of the longitudinal side wall.

10. The bed base of claim 1 further comprising a corner piece engaged with the side walls at an area of intersection of a longitudinal side wall with a transverse side wall.

11. The bed base of claim 10 wherein each corner piece comprises a first channel for receiving an upper web of a transverse side wall and a second channel for receiving an upper web of a longitudinal side wall.

12. The bed base of claim 10 wherein the corner piece further comprises a back which fits against exterior surfaces of an intersecting transverse side wall and longitudinal side wall.

13. The bed base of claim 1 further comprising a corner guard which fits over an exterior of a corner formed by an intersection of a transverse side wall and a longitudinal side wall.

14. The bed base of claim 1 further comprising a corner piece engaged with the side walls at an area of intersection of a longitudinal side wall with a transverse side wall and a corner guard which fits over an exterior of a corner formed by an intersection of a transverse side wall and a longitudinal side wall.

15. A bed base for supporting a mattress or mattress foundation, the bed base comprising:

four intersecting side walls, each side wall having:

a length dimension between ends where the side walls intersect, and a height dimension between upper and lower edges, an upper web formed along the upper edges, a lower web formed along the lower edges, an upper tab formed in the upper web at ends of two of the side walls, and a lower slot formed in the lower web at the ends of the same two side walls, an upper slot formed in the upper web at ends of the remaining two side walls, and a lower tab formed in the lower web at ends of the remaining two side walls;

the upper tabs of two of the side walls engaged with the corresponding upper slots of the remaining two side walls, and the lower tabs of the remaining two side walls engaged with the lower slots of the two side walls.

16. The bed base of claim 15 further comprising at least one cross brace which extends across two parallel side walls and intersects the upper webs of the two parallel side walls.

17. The bed base of claim 16 wherein the at least one cross brace further comprises at least one cross brace leg which extends from the cross brace to a lower web of one of the two parallel side walls.

18. The bed base of claim 16 wherein the at least one cross brace leg is substantially located between an upper web and a lower web of a side wall.

19. The bed base of claim 16 wherein the at least one cross brace comprises a horizontal segment and a vertical segment which intersects the upper webs of the two parallel side walls.

20. The bed base of claim 15 further comprising a corner piece which fits over the upper webs of two intersecting side walls.

21. The bed base of claim 19 wherein the corner piece comprises first and second channels in which the upper webs of the intersecting side walls are received.

22. The bed base of claim 15 further comprising a corner guard which extends over exterior surfaces of intersecting side walls.

23. The bed base of claim 15 wherein each upper web has a first segment which extends from the plane of the side wall and a second segment which extends perpendicular from the first segment and parallel to the plane of the side wall.

24. The bed base of claim 15 wherein each lower web has a first segment which extends from the plane of the side wall and a second segment which extends perpendicular from the first segment and parallel to the pane of the side wall.

25. The bed base of claim 15 wherein the lower web is dimensionally larger than the upper web.

* * * * *